US008327837B2

(12) United States Patent
Nam et al.

(10) Patent No.: US 8,327,837 B2
(45) Date of Patent: Dec. 11, 2012

(54) COOKING RANGE WITH ROTABLE RACK

(75) Inventors: Hyeun Sik Nam, Seoul (KR); Dong Seong Kwag, Seoul (KR); Wan Soo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 285 days.

(21) Appl. No.: 12/764,179

(22) Filed: Apr. 21, 2010

(65) Prior Publication Data

US 2010/0276414 A1 Nov. 4, 2010

(30) Foreign Application Priority Data

Apr. 30, 2009 (KR) ..... 10-2009-0038091

(51) Int. Cl.
*F24C 15/16* (2006.01)

(52) U.S. Cl. ..... 126/338; 219/392

(58) Field of Classification Search ..... 126/338; 219/392

See application file for complete search history.

(56) References Cited

U.S. PATENT DOCUMENTS

| | | | | |
|---|---|---|---|---|
| 3,859,499 | A * | 1/1975 | Evans et al. | 219/396 |
| 5,520,099 | A | 5/1996 | Chung | |
| 5,771,786 | A | 6/1998 | Chung | |
| 2005/0252905 | A1 * | 11/2005 | De'Longhi | 219/403 |

FOREIGN PATENT DOCUMENTS

| | | | |
|---|---|---|---|
| JP | 2001-520793 | A | 10/2001 |
| KR | 10-20060036997 | A | 5/2006 |
| KR | 10-0826702 | B1 | 4/2008 |
| WO | WO 96-07299 | A1 | 3/1996 |

OTHER PUBLICATIONS

International Search Report dated Jan. 24, 2011 for Application No. PCT/KR2010/002757, 3 pages.

* cited by examiner

*Primary Examiner* — Julio J Maldonado
*Assistant Examiner* — Robert Bachner
(74) *Attorney, Agent, or Firm* — Fish & Richardson P.C.

(57) ABSTRACT

A cooking range includes a cook top section. The cooking range also include an oven section having walls defining a cavity and a door, wherein the cavity being configured to accommodate food and the door being configured to open or close the cavity. The cooking range further include a heating source configured to provide heat to the cavity when the cooking range is operated. In addition, the cooking range include a rack member coupled to the cavity, and configured to support a food container placed thereon, wherein at least a part of the rack member is configured to be rotated to rotate the food thereon.

21 Claims, 5 Drawing Sheets

COOKING RANGE WITH ROTABLE RACK

CROSS-REFERENCE TO RELATED APPLICATION

The present application is claims benefits of priority to Korean Application Number 10-2009-0038091, filed Apr. 30, 2009, which is herein expressly incorporated by reference in its entirety.

FIELD

The present disclosure relates to a cooking range.

BACKGROUND

A conventional cooking range includes an oven section indirectly heating foods using high temperature heat air to heat object within its cabin, which forms a tight space, and a cook-top section directly heating the foods, wherein the oven section and the cook-top section are conventionally combined in a single unit.

The cooking range may be categorized into three types based on the types of heat sources, that are an electric oven range adopting an electric heater as a heat source, a microwave oven equipped with a magnetron which heats the foods via penetration of microwaves generated from a super high frequency oscillator into the foods, and a gas oven using flames from a gas fuel burner for heating the foods.

The conventional cooking ranges also includes a cavity that is heated for cooking foods. The cavity is opened or closed by a door that is moveable to provide access to the cavity. An internal of the cavity is horizontally defined with racks provided to enable multiple trays, pans or pots of food items to be placed therein at different levels within the cavity. The racks are moveable toward the door along a guide rail formed inside the cavity.

When foods are cooked, the racks are dragged outside of the cavity and if the foods are well cooked, the foods are taken out from the cavity. Yet, to evenly cook the foods, there may be desirable to rotate them, and it may be desirable to do so without physical touch or integrating with food container within the oven. The conventional cooking ranges have the inconvenience of rotating the foods by hands instead of rotating the rack by a separate mechanism.

SUMMARY

In one aspect, a cooking range includes: a cook top section; an oven section having walls defining a cavity and a door, wherein the cavity being configured to accommodate food and the door being configured to open or close the cavity; a heating source configured to provide heat to the cavity when the cooking range is operated; and a rack member coupled to the cavity, and configured to support a food container placed thereon, wherein at least a part of the rack member is configured to be rotated to rotate the food thereon.

In another aspect, a cooking range includes: a cook top section; an oven section having walls defining a cavity and a door, wherein the cavity being configured to accommodate food and the door being configured to open or close the cavity; a heating source configured to provide heat to the cavity when the cooking range is operated; and a rack member coupled to the cavity, and configured to support a food container placed thereon, wherein the rack member having a first rack coupled to the walls of the cavity and configured to slide along a guide member and a second rack coupled to the first lack and configured to rotate with respect to the first rack to rotate the food thereon.

In yet, another aspect, a cooking range includes: a cook top section; an oven section having a cavity and a door, wherein the cavity being configured to accommodate a food and the door being configured to open or close the cavity; a heating source configured to provide heat to the cavity when the cooking range is operated; and a rack member coupled to the cavity, and configured to put the food on, wherein the rack member having a first rack coupled to an inner wall of the cavity and configured to move along a guide member and a second rack coupled to the first rack and configured to move independently from the first rack, wherein the first and the second rack are moving together when the first rack moves.

DETAILED DESCRIPTION

The structure and operation of a rotational rack and a cooking range including the same will be described in detail with reference to FIGS. 1 to 4.

Figure 1:
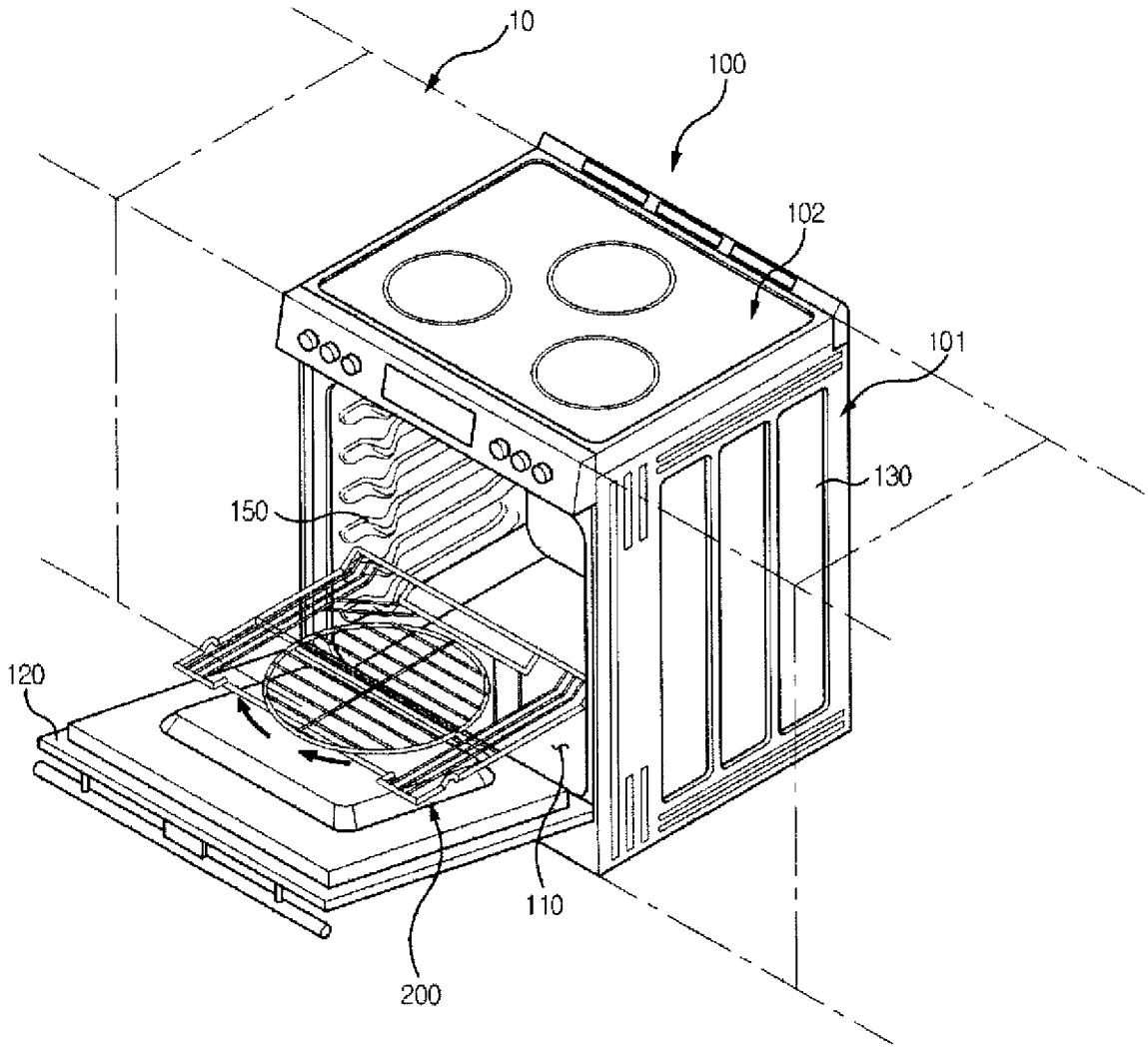
FIG. 1 is a view illustrating a cooking range.

As shown in FIG. 1, a cooking range 100 includes an oven section 101 indirectly heating foods such as cakes, bread and barbecues by using a high temperature heat air in a space, and a cook-top section 102 positioned at an upper side of the oven section 101 directly heating the foods.

A heat source heating the oven section 101 may be, for example, an electric heater, a microwave, a gas flame or the like.

The surrounding of the oven section 101, where a temperature is also high, is filled by an insulating material for preventing heat loss and accidental fire. And outside of the insulating material is covered by a side panel 130. The side panel 130 prevents the constituent elements of the cooking range 100 from being exposed to the outside to make an exterior look of the cooking range 100 clean and beautiful.

The cooking range 100 may be categorized into two types based on installation, which are a free standing type and a built-in type. The free standing type is an independent type that the cooking range 100 is independently located from a kitchen furniture 10 On the contrary, the built-in type is a combination type that the cooking range 100 is positioned between the side panel 130 and the kitchen furniture. In this implementation, a built-in type cooking range 100 may not need installation of the side panel 130.

In some implementations, in a case a particular part of the cooking range 100 is concentrated with heat or the kitchen furniture about the cooking range 100 may get overheated (e.g., 90° C. or more.), The overheating phenomenon may be restricted by using insulation material that wraps the oven section 101.

In case of the free standing type cooking range 100, an empty space is defined between the side panel 130 and the oven section 101 such that the air may be circulated.

The oven section 101 includes a cavity 110 and a door 120. The cavity 110, having a space for cooking foods, is opened or closed by the door 120, and a rotational rack 200 on which foods are placed is positioned in the space as shown in FIG. 1. When the foods are placed on the rotation rack, the foods are rotated based on rotation of the rotation rack 200. Therefore, a user may easily take out the food placed on the rotation rack 200 after rotating the rack 200.

Figure 2:
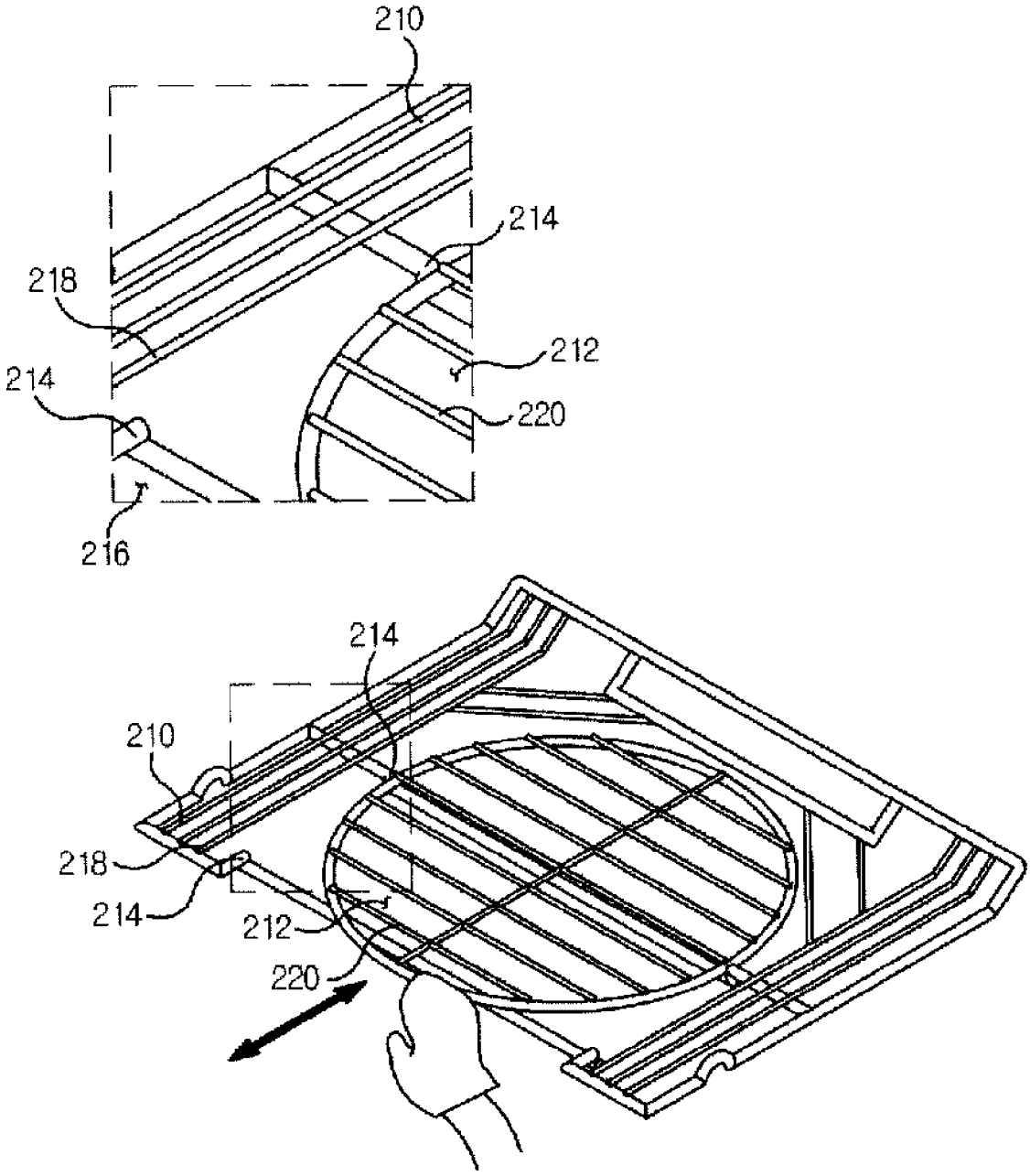
FIG. 2 is a view illustrating a rotational rack.

Referring to FIG. 2, the rotational rack 200 may include a first rack 210 and a second rack 220. The first rack 210 slides along a guide member 150 at an inner wall of the cavity 110 as shown in FIG. 1. A plurality of guide members 150 are arranged at an inner wall of the cavity 110, whereby the user can adjust an installation height of the rotational rack 200. As a result, an appropriate height of guide member 150 may be selected to cater to the size of the food into which the first rack 210 is inserted.

The second rack 220 is rotatively and slidingly connected to the first rack 210. The second rack 220 is rotated on a plane parallel with the first rack 210.

Figure 3:
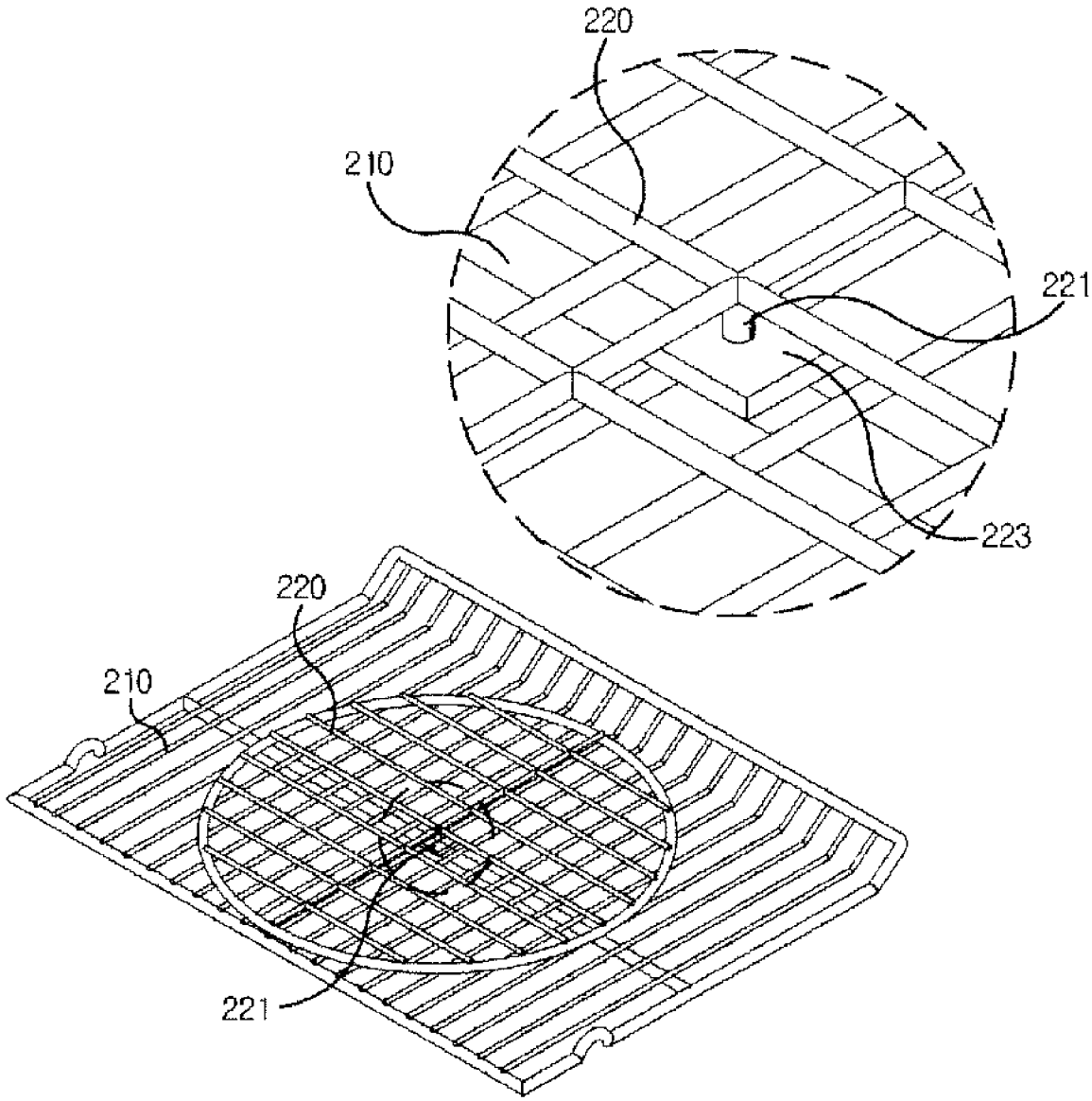
FIG. 3 is a view illustrating a rotational rack.
Figure 4:
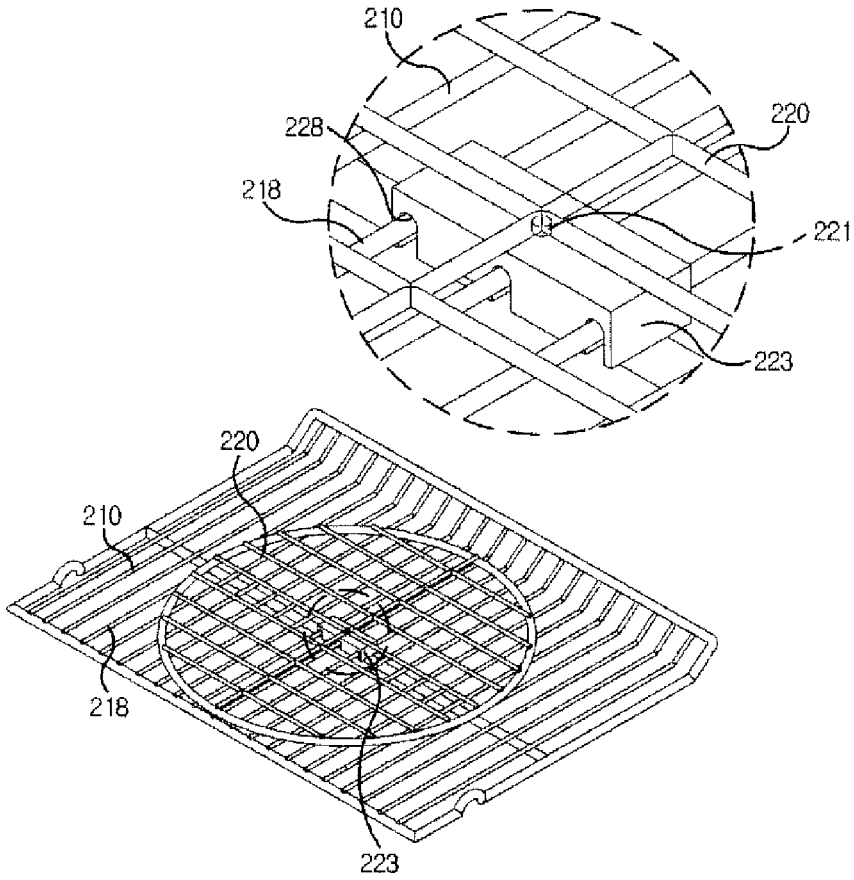
FIG. 4 is a view illustrating a rotational rack.

The second rack 220 can be rotated with a rotation shaft 221 or without the rotation shaft 221. If the second rack 220 is rotated using the rotation shaft 221, the second rack may include a rotation shaft holder 223 fixedly installed at the first rack 210, as shown in FIG. 3, with the rotation shaft holder 223 being slidable along the first rack 210, as shown in FIG. 4.

Referring to FIG. 2, the second rack 220 is supported by an upper surface of the first rack 210. In order to stably support the second rack 220 by the first rack 210, a part of the first rack 210 is coupled to the second rack 220 protrudes toward an upper surface of the first rack 210 to define a sill 212 having a height direction stair at a center of the first rack 210. The second rack 220 may rotate or slide within the sill 212 while being contacted by the sill 212.

In order to guide the rotation or sliding of the second rack 220, a guide sill 214 is located at a periphery of the sill 212. In some examples, an outer circumference of the second rack 220 is rounded, wherein the outer circumference of the second rack 220 is contacted or interfered by the guide sill 214 to guide the second rack 220 to rotate or slide. In some exemplary embodiments, the second rack 220 can be simply detached from the sill 212, for example, by lifting the second rack 220 if there is a need of cleaning the second rack 220 after the cooking is done.

Further, the second rack 220 may be drawn out toward the door 120, toward or away from the cavity 110. The second rack 220 also may be used to rotate the food. During cooking the foods, if necessary, a position of the food may be changed by rotating the second rack 220. In order to ease the access of the second rack 220 when the second rack 220 is rotated or drawn out by hand, a recess 216 may be provided at a forward end of the first rack 210 facing the door 120. For example, in order that the second rack 220 is easily rotated or slid by manipulating by hand, part of the second rack 220 that may have the recess 216 exposed to the recess 216.

Referring to FIG. 3, a rotation shaft 221 is coupled to the second rack 220. The second rack 220 may be rotated at a predetermined distance from an upper surface of the first rack 210. The first rack 210 and the second rack 220 may be discretely installed toward the height direction because the rotation shaft 221 and a rotation shaft holder 223 being positioned between the first rack 210 and the second rack 220 in the height direction. As a result, even if the second rack 220 is warped the first rack 210 or an assembled state between the second rack with the first rack is partially twisted in a long use, the second rack 220 is able to smoothly rotate without being interfered by the first rack 210.

Further, the rotating shaft holder 223 is positioned between the first rack 210 and the second rack 220 in the height direction. The rotation shaft holder 223 supports the rotation shaft 221. Here, a rotation shaft 221 may be a rotation center of the second rack 220.

In some implementations, the rotation shaft holder 223 is positioned at an upper surface of the first rack 210 when the rotation shaft 221 is extended to a bottom surface of the second rack 220. The rotation shaft 221 is also positioned at the upper surface of the first rack 210 when the rotation shaft holder 223 is located at a bottom surface of the second rack 220. A bearing may be provided inside of the rotation shaft holder 223 for smooth rotation of the rotation shaft 221.

The rotation shaft holder 223 may be fixed at a point of the rotational rack 200 as shown in FIG. 3, or may be slidingly installed toward the door 120 or toward the cavity 110 as shown in FIG.

Referring to FIG. 4, the first rack 210 includes a plurality of rods 218 extended toward the door 120. The rotation shaft holder 223 may include at least one insertion groove 228, and the sliding of the second rack 220 is guided by the rods 218 of the first rack 210 being slidingly inserted into the insertion groove 228 of the rotation shaft holder 223.

If the rotation shaft holder 223 is fixedly installed, the second rack 220 will be less likely overthrown by the load deviation of the food, and if the rotation shaft holder 223 is slidingly installed, the food may be inserted or removed by sliding the second rack 220.

Furthermore, if the first rack 210 is inserted into the guide member 150 at the inner wall of the cavity 110 and the second rack 220 only is separable, the rotational rack 200 can be easily cleaned. In addition, the rotation shaft 221 is assembled with the rotation shaft holder 223 in the attachable and detachable manners and the second rack 220 is separated by operation of separating the rotation shaft 221 from the rotation shaft holder 223.

In some exemplary implementations, if the rotation shaft holder 223 is separable, the second rack 220 may be also separated by operation of separating the rotation shaft 221 and the rotation shaft holder 223 from the first rack 210. Referring to FIG. 4, the second rack 220 can be easily separated by operation of separating the insertion groove 228 of the rotation shaft holder 223 from the rod 218 of the first rack 210.

Further, an inconvenience of use, or an incident of the food being overthrown in the process of the food being inserted may occur if the user does not operate the second rack 220 accurately, for example, the second rack 220 rotates over a predetermined angle or rotates unintentionally. So, the second rack 220 may be arbitrarily rotated. To prevent an unexpected rotation of the second rack 220, a structure for restriction of the rotation of the second rack 220 defined as "rotational direction motion", may be provided.

Figure 5:
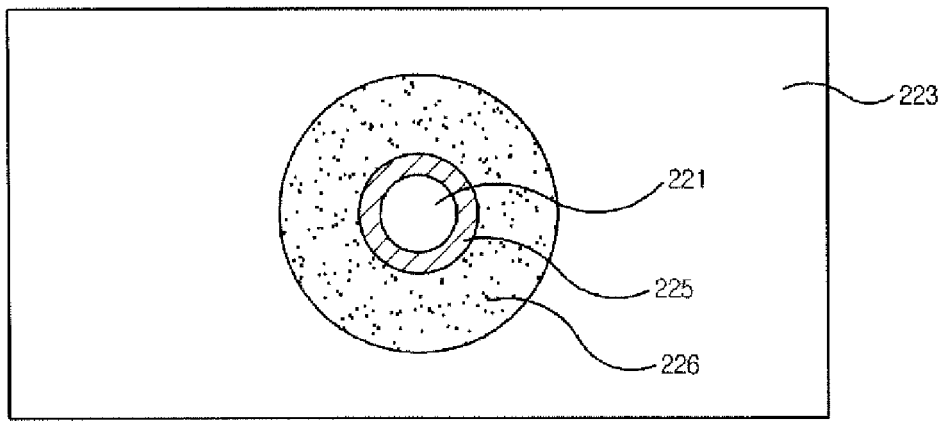
FIG. 5 is a plane view illustrating a friction member.
Figure 6:
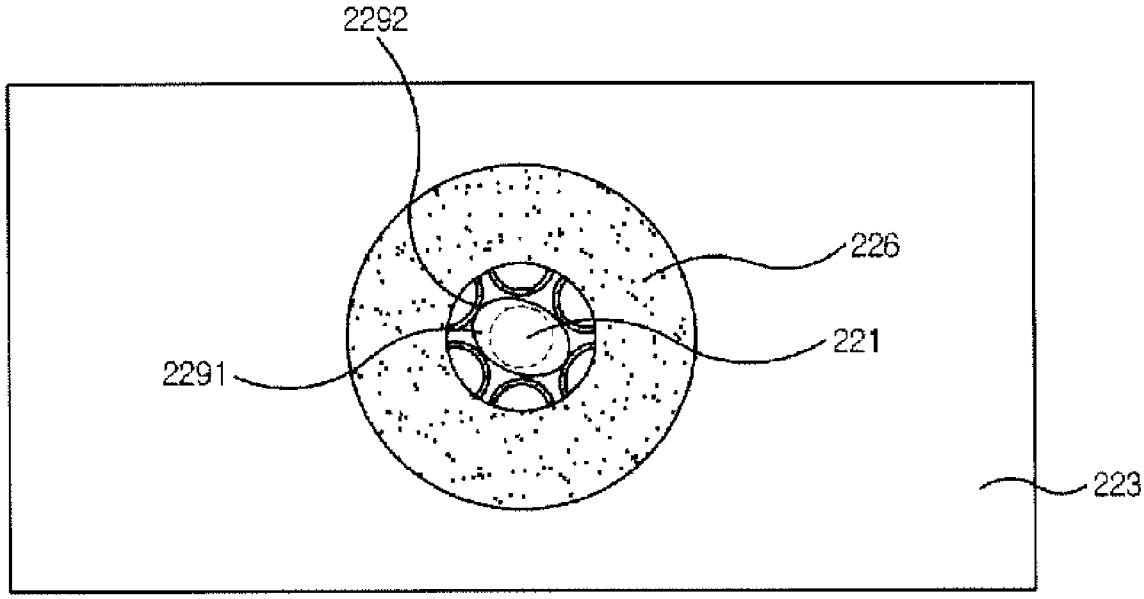
FIG. 6 is a plane view illustrating a cam and an elastic member.

In some implementations, the restriction structure may include the sill 212 or the guide sill 214 as shown in FIG. 2. the restriction structure may include the friction member 225 as shown in FIG. 5. the restriction structure may include a cam 2291 or an elastic member 2292 as shown in FIG. 6.

The sill 212 and the guide sill 214 restrict the rotational direction motion based on supportive contact with the first rack 210 and the second rack 220. As shown in FIG. 5, the friction member 225 is interposed between the rotation shaft 221 and the rotation shaft holder 223 and applies a predetermined level of frictional force to the rotation shaft 221 to limit the rotational direction motion of the second rack 220.

Referring to FIG. 6, the cam 2291 and the elastic member 2292 are interposed between the rotation shaft 221 and the rotation shaft holder 223 and apply an intermittent elastic load based on a rotational angle of the rotation shaft 221 to restrict the rotational direction motion.

In some examples, if the cam 2291 integrally assembled to the rotation shaft 221 is elastically deformed by the depression of the elastic member 2292, an elastic load that restricts the rotation of the rotation shaft 221 increases. If the cam 2291 passes a peak point that deforms the elastic member 2292 to a maximum, the elastic member 2292 is restored to decrease the elastic load. As noted, the elastic load may be increased by the rotation of the rotation shaft 221. For example, per each predetermined angle, the rotation load of the rotation shaft 221 may be increased to restrict the rotational direction motion of the second rack 220.

In this implementation, in addition to the motion of operating the second rack 220 such as rotation or sliding by hand, a driving source and a power transmission member for rotating the second rack 220 may be provided. For example, a barbecue rod is inserted on the second rack 220, the rotational force of the barbecue rod is transmitted to the second rack 220 via the power transmission member to automatically rotate the second rack 220.

Now, the operation of the rotational rack 200 will be described in the following. In a case the food is put into the cavity 110, the first rack 210 guided along the guide member 150 is drawn out toward the door 120, and the food is put on the second rack 220. Then, the first rack 210 is pushed into the cavity 110 and the door 120 is closed. In this implementation, the first rack may be slid in and out in connection with open and close operations of the door 120. When the user opens the door 120, the first rack 210 is drawn out toward the door 120. And, when the user close the door 120, the first rack 210 is pushed into the cavity.

If rotation of food is necessary during cooking of the food, the door 120 may be opened to rotate the second rack 220. And then, the second rack 220, as a discrete member positioned at a predetermined space toward an upper side compared to the first rack 210, may be rotated by hand or by the driving force.

In a case restriction structure is provided, the second rack 220 rotates up to an arbitrary rotational direction. If the food is completed in cooking, the first rack 210 is drawn out toward the door 120 to take out the food. Furthermore, in a case the second rack 220 is needed to be cleaned, only the second rack 220 may be separated from the first rack 210.

As apparent from the foregoing, the rotational rack of the cooking range can rotates the food. The arbitrary motion of rotational direction by the second rack may be restricted.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A cooking range comprising:

a cook top section;

an oven section having walls defining a cavity and a door, the cavity being configured to accommodate food and the door being configured to open or close the cavity;

a heating source configured to provide heat to the cavity when the cooking range is operated; and a rack member located in the cavity, the rack member comprising:

a first rack coupled to an inner wall of the oven section and configured to slide along a guide member; and a second rack coupled to the first rack and configured to rotate with respect to the first rack, the second rack being configured to support a food container placed thereon and being configured to be rotated to rotate the food container placed thereon;

a rotation shaft coupled to the second rack and configured to rotate the second rack with respect to the first rack;

a restriction member configured to restrict a rotation direction motion including a rotation angle of the second rack by applying force to the rotation shaft that is in addition to force applied to the rotation shaft due to rotating the second rack;

a driving source configured to generate a driving signal; and a transmission member configured to transmit the driving signal to the second rack.

2. A cooking range comprising:

a cook top section;

an oven section having walls defining a cavity and a door, the cavity being configured to accommodate food and the door being configured to open or close the cavity;

a heating source configured to provide heat to the cavity when the cooking range is operated; and a rack member located in the cavity, the rack member having:

a first rack that is coupled to the walls of the oven section, that is configured to slide along a guide member, and that includes a plurality of rods, and a second rack coupled to the first rack and configured to rotate with respect to the first rack, the second rack being configured to support a food container placed thereon and being configured to be rotated to rotate the food container placed thereon;

a rotation shaft coupled to the second rack and configured to rotate the second rack with respect to the first rack;

a rotation shaft holder coupled to the plurality of rods of the first rack and configured to support the rotation shaft; and a restriction member configured to restrict a rotation direction motion including a rotation angle of the second rack, the restriction member comprising a friction member interposed between the rotation shaft and the rotation shaft holder.

3. The cooking range of claim 2, wherein the restriction member comprises a cam and an elastic member.

4. The cooking range of claim 2, further comprising:

a driving source configured to generate a driving signal; and a transmission member configured to transmit the driving signal to the rack member.

5. The cooking range of claim 2, wherein the second rack is rotated on a plane coupled to the first rack.

6. The cooking range of claim 2, wherein a part of the first rack coupled to the second rack.

7. The cooking range of claim 2, further comprising:

a guide sill is positioned at an outer circumference of the second rack and configured to contact the second rack when the second rack is rotated.

8. The cooking range of claim 2, further comprising:

a recess positioned at a forward end of the first rack facing the door, wherein a part of the second rack is exposed to the recess.

9. A cooking appliance comprising:

an oven section having walls defining a cavity and a door, the cavity being configured to accommodate food and the door being configured to open or close the cavity;

a heating source configured to provide heat to the cavity when the cooking range is operated; and a rack member located in the cavity, the rack member comprising:

a first rack coupled to an inner wall of the oven section and configured to slide along a guide member; and a second rack coupled to the first rack and configured to rotate with respect to the first rack, the second rack being configured to support a food container placed thereon and being configured to be rotated to rotate the food container placed thereon;

a rotation shaft coupled to the second rack and configured to rotate the second rack with respect to the first rack; and a restriction member configured to restrict a rotation direction motion including a rotation angle of the second rack by applying force to the rotation shaft that is in addition to force applied to the rotation shaft due to rotating the second rack.

10. The cooking appliance of claim 9, further comprising:

a driving source configured to generate a driving signal; and a transmission member configured to transmit the driving signal to the second rack.

11. The cooking appliance of claim 9, wherein the first rack comprises a plurality of rods, further comprising:

a rotation shaft holder coupled to the plurality of rods of the first rack and configured to support the rotation shaft.

12. The cooking appliance of claim 11, wherein the rotation shaft and the rotation shaft holder are positioned between the first rack and the second rack and the second rack is configured to rotate at a predetermined distance above an upper surface of the first rack.

13. The cooking appliance of claim 11, wherein the rotation shaft is located at a center of rotation of the second rack.

14. The cooking appliance of claim 11:

wherein the rotation shaft holder includes at least one insertion groove;

wherein at least one of the plurality of rods of the first rack is slidably inserted into the at least one insertion groove of the rotation shaft holder; and wherein the second rack is configured to slide relative to the first rack based on the rotation shaft holder sliding on the at least one of the plurality of rods of the first rack that is slidably inserted into the at least one insertion groove of the rotation shaft holder.

15. The cooking appliance of claim 11:

wherein the rotation shaft holder includes more than one insertion groove;

wherein more than one, but less than all, of the plurality of rods of the first rack are slidably inserted into the more than one insertion groove of the rotation shaft holder; and wherein the second rack is configured to slide relative to the first rack based on the rotation shaft holder sliding on the more than one of the plurality of rods of the first rack that are slidably inserted into the more than one insertion groove of the rotation shaft holder.

16. The cooking appliance of claim 9, wherein the restriction member comprises a friction member that is interposed between the rotation shaft and the rotation shaft holder and that applies a predetermined level of frictional force to the rotation shaft to limit the rotation direction motion of the second rack.

17. The cooking appliance of claim 9, wherein the restriction member comprises a cam and an elastic member that are interposed between the rotation shaft and the rotation shaft holder and that apply an intermittent elastic load based on a rotational angle of the rotation shaft to restrict the rotation direction motion of the second rack.

18. The cooking appliance of claim 17, wherein the cam is integrally assembled to the rotation shaft and an elastic load that restricts rotation of the rotation shaft increases as the cam is elastically deformed by depression of the elastic member.

19. The cooking appliance of claim 18, wherein the elastic member is restored to decrease the elastic load that restricts rotation of the rotation shaft based on the cam passing a peak point that deforms the elastic member to a maximum.

20. The cooking appliance of claim 17, wherein the cam and the elastic member are configured to increase an elastic load that restricts rotation of the rotation shaft at each of multiple predetermined angles of rotation.

21. The cooking appliance of claim 9, wherein the rotation shaft is arranged with its rotation axis vertical and perpendicular to a top surface of the second rack on which the food container is placed.

* * * * *